United States Patent [19]

Holzwarth

[11] 4,255,868

[45] Mar. 17, 1981

[54] METHOD AND DEVICE FOR OPTIMALLY STABILIZING THE WINDINGS OF TRANSFORMERS AND CHOKES

[75] Inventor: Siegfried Holzwarth, Viernheim, Fed. Rep. of Germany

[73] Assignee: Brown, Boveri & Cie AG, Mannheim-Käfertal, Fed. Rep. of Germany

[21] Appl. No.: 38,327

[22] Filed: May 11, 1979

[30] Foreign Application Priority Data

May 12, 1978 [DE] Fed. Rep. of Germany ..... 2820740

[51] Int. Cl.[3] ..... F26B 7/00; F26B 9/04

[52] U.S. Cl. ..... 34/12; 34/19; 34/143; 100/93 P; 100/258 A

[58] Field of Search ..... 100/46, 93 P, 258 R, 100/258 A; 34/12, 19, 143, 145

[56] References Cited

U.S. PATENT DOCUMENTS

| | | | |
|---|---|---|---|
| 435,309 | 8/1890 | Jones | 100/266 |
| 1,393,035 | 10/1921 | Morris | 100/93 P |
| 1,677,963 | 7/1928 | Ford | 34/143 X |
| 3,059,431 | 10/1962 | Munschauer, Jr. et al. | 100/46 |

*Primary Examiner*—John J. Camby
*Attorney, Agent, or Firm*—Herbert L. Lerner

[57] ABSTRACT

Method for optimally stabilizing the winding of transformers and chokes, which includes pressing at least one winding in a drying oven at constant pressure during the entire drying process, and subjecting each winding to its required pressure if more than one winding is to be pressed simultaneously.

19 Claims, 3 Drawing Figures

METHOD AND DEVICE FOR OPTIMALLY STABILIZING THE WINDINGS OF TRANSFORMERS AND CHOKES

The present invention relates to a method for optimally stabilizing the windings of transformers and chokes as well as to a device for carrying out such a method.

The windings of transformers and chokes customarily are formed of paper-insulated wires which are spaced from each other by pressboard strips. Since the windings must not change during operation, but paper and pressboard shrink if they lose moisture and when they are under compression stress, the windings must be pretreated accordingly. For this purpose, moisture is removed therefrom in a drying process while they are simultaneously subjected to a certain amount of pressure. This combined application of pressure and drying is usually called stabilizing.

As is well known, stabilization is performed by compressing the winding with the specified pressure through the use of several hydraulic jacks disposed at one end face of the winding between two pressure plates. The hydraulic jacks are then relieved by mechanical elements, e.g., screws or blocks, so that they can be removed again. The winding is subsequently placed with the pressing fixture in a drying oven, in which the water bound in the paper insulation as well as in the pressboard strips escapes through evaporation. When the water evaporates, the insulation shrinks and the pressure exerted on the winding by the mechanical elements decreases. It has been found that the pressure may even reach zero in some circumstances.

After about 24 hours, the oven is opened as soon as the oven and the winding have cooled down to about 40° C. The hydraulic jacks are reinserted and again brought to the specified pressure. Subsequently, the mechanical elements are readjusted, the hydraulic jacks removed, the oven closed an heated up again. After another 24 hours this process must be repeated once more and possibly more often.

It is obvious that this customary method is associated with important disadvantages. Thus, considerable heat and time are lost with each opening of the oven, and the insertion and removal of the hydraulic jacks, as well as the readjustment of the mechanical tightening elements each of which requires a large amount of labor. In addition, this method has the disadvantage that similar windings shrink during the stabilizing process in different degrees, especially since the percent shrinkage of the pressboard depends heavily on the pressure applied during the drying process.

It is also known to generate the pressure, instead with hydraulic jacks and mechanical tightening elements, either directly or by spring elements such as coil springs or cup springs, etc. However, it is easy to see that, according to the spring characteristic, the pressure decreases as the winding shrinks, so that retightening of the springs during the stabilizing process with the above-described disadvantages becomes necessary.

It is therefore an object of the present application to provide a method and device for optimally stabilizing the windings of transformers and chokes and to reduce the time required and lower the labor cost.

With the foregoing and other objects in view, there is provided, in accordance with the invention, a method for optimally stabilizing the windings of transformers and chokes, which comprises pressing at least one winding in a drying oven at constant pressure during the entire drying process, and subjecting each winding to its required pressure if more than one winding is to be pressed simultaneously.

This results in the advantages that manual readjustment of the pressure devices by the above-described methods becomes unnecessary, which substantially reduces the labor required; that the repeated opening and closing as well as heating up and cooling down of the drying oven is obviated, which shortens the time of the stabilizing process; that it is possible to calculate the final length of the winding in advance, since the percent shrinkage of the pressboard strips due to the constant pressure during the entire stabilizing process can be reliably predicted; and that the windings shrink uniformly, so that like windings always attain equal length after the stabilizing process. The method according to the invention therefore achieves not only mechanization of production but at the same time achieves a qualitative improvement of the product.

In accordance with another mode of the invention, there is provided a method which includes varying the pressure applied to each winding in proportion to the initial length of the winding. Since the percent shrinkage of the pressboard strips depends on the pressure applied during the stabilizing process, possible dimensional tolerances can be equalized by such an individual variation of the pressure.

As already mentioned at the outset, the known devices for stabilizing the windings of transformers and chokes consist of two fixed pressure plates which are connected to each other by press rods, and of a movable pressure plate. The winding to be pressed is placed between a fixed pressure plate and the movable pressure plate, while the devices for generating the pressure are disposed between the movable pressure plate and the other fixed pressure plate.

In accordance with the device of the invention for carrying out the method, there is provided a device for carrying out a method for optimally stabilizing the windings of transformers and chokes in a drying oven with a pressing fixture having two fixed pressure plates, rods connected between the fixed pressure plates, a movable pressure plate disposed between the fixed pressure plates, and means for exerting pressure on an end face of a winding disposed between one fixed pressure plate and the movable pressure plate, the pressure exerting means comprising a multiplicity of hydraulic jacks fixed in place, i.e. unremovable, during the stabilizing process, a first hydraulic line connecting the jacks to each other, and a second hydraulic line connecting the first hydraulic line to a hydraulic control system disposed outside the drying oven.

Such a device has the advantages that the pressure can be held constant during the entire stabilizing process in the oven; that all jacks exert the same pressure onto the winding at all times; nd that the hydraulic pressure can be generated and monitored from a point outside the oven; the transmission of the pressure from the outside into the oven is very simple.

Although it would suffice to simply place the hydraulic jacks between one of the fixed, and the movable pressure plate, the jacks are advantageously fastened to on of the pressure plates and preferably, in accordance with a further feature of the invention, the hydraulic jacks are screwed into tapped holes formed in one pressure plate. This results in important simplifications in assembling and disassembling the pressing device.

The hydraulic jacks are preferably fastened to the upper, fixed pressure plate, since in this manner the connections of the hydraulic jacks as well as the hydraulic lines connecting the jacks to each other are readily accessible.

In accordance with an additional feature of the invention, there is provided an at least two-way or possibly three-way distribution valve disposed on an outer surface of one of the fixed pressure plates, the distribution valve being connected between the first and second hydraulic lines.

In accordance with an added feature of the invention, the hydraulic jacks are temperature resistant to at least 410 K.

In accordance with yet another feature of the invention, there is provided a hydraulic pump connected to the second hydraulic line, and electrically actuatable valve means inserted in one of the hydraulic lines.

In accordance with a further feature of the invention, there are provided overpressure valve means inserted in one of the hydraulic lines.

In accordance with an additional feature of the invention, there is provided a contact manometer inserted in one of the hydraulic lines, the manometer having settable desired pressure and overpressure contacts. By means of the electrically actuated valves, the pressure in the line between the hydraulic pump and the hydraulic jacks is released during the time when the hydraulic system is activated, and is shut off during the rest of the time. The specified pressure is set by means of the overpressure valve. The underpressure contact of the contact manometer is set so that it does not respond if the system operates properly but responds reliably in the event of a defect in the hydraulic line. If necessary, the electrically actuated valves are shut off by means of this contact so that no pressurized oil is pumped into the defective connection.

In accordance with yet an added feature of the invention, there are provided timing means connected to the control system for activating the control system at intervals and regulating the pressure in the hydraulic jacks. It has been found that it is not necessary to monitor the pressure during the stabilizing process without interruption and to regulate it to the specified pressure. Considerable savings are achieved if the pressure is checked and readjusted at intervals of 1 to 30 minutes, while in between, the hydraulic pump which supplied the hydraulic jacks with pressurized oil, remains switched off. The pressure drop due to the shrinking of the winding which occurs during the intervening time is so small that no negative effect on he shrinking of the winding can be found. In accordance with the method of employing the device of the instant application, there is provided a method for stabilizing the windings of transformers and chokes in a drying oven, which comprises inserting a winding which has been prepared for drying between a fixed and a movable pressure plate of a pressing fixture, exerting a desired pressure on the movable pressure plate with hydraulic jacks, placing the pressing fixture in a drying oven, setting the desired pressure with a hydraulic control system disposed outside the oven and connected to the jacks, heating the drying oven, continuously regulating the pressure in the jacks to desired values during the drying process with the control system, and maintaining a constant pressure with the jacks after the drying process is completed and until the winding has cooled.

In accordance with another mode of the invention, there is provided a method which includes exerting pressure through a common hydraulic line connected to a plurality of jacks which act on a particular winding in a pressing fixture. This makes the pressure distribution on the end face of the winding the same everywhere. With this method, the winding shrinks completely uniformly during the stabilizing process and the final length of the winding after the stabilizing process can be calculated in advance since the shrinkage, as is well-known, also depends on the pressure to which the winding had been subjected during the drying process.

If several windings of the same type are dried in the oven at the same time, in accordance with a further mode of the invention, there is provided a method which includes exerting pressure through a common hydraulic line connected to a plurality of jacks which act on a plurality of windings of the same type. In this manner, the number of pressure lines that must be brought into the drying oven and must be regulated independently of each other, can be kept small.

In accordance with an additional mode of the invention, there is provided a method which includes adjusting the pressure supplied to the jacks to desired values at fixed time intervals.

In accordance with an added mode of the invention, there is provided a method which includes adjusting the pressure supplied to the jacks to desired values if the pressure deviates from the desired values by given amounts.

In accordance with still another mode of the invention, there is provided a method which includes adjusting the pressure supplied to the jacks by activating a hydraulic pump and hydraulic valves connected to the common hydraulic line.

Should difficulties arise when the pressurized oil is pumped back after the stabilizing process because the oil is heated to a high temperature, the winding with the pressing fixture, including pressure oil, is advantageously allowed to cool down outside the drying oven and, in accordance with still a further mode of the invention, there is provided a method which includes draining the hydraulic jacks after the stabilized winding has cooled.

Since in the hydraulic system, pressure of several hundred bar are required and the installation must operate at high temperatures in the drying oven, it is never entirely impossible for a break or a lead to occur in the hydraulic system. In such a case, the hydraulic control system would attempt to maintain the pressure, but the pressure oil would be pumped through the leak and lost. For this reason, reconnecting the defective hydraulic part is prevented after a pressure drop, the magnitude of the pressure drop after which reconnecting is effected, is adjustable. Therefore, in accordance with a concomitant mode of the invention, there is provided a method which includes diverting the supply of hydraulic pressure at least partly through another hydraulic line if a drop in pressure occurs due to a break in the hydraulic system.

As already mentioned, it is not necessary to keep the hydraulic pump in operation during the entire stabilizing process, but it is sufficient to check and regulate the pressure at definite intervals. These intervals can be predetermined by means of a timer according to a preset schedule. However, it is also possible to use a contact manometer for this purpose which activates the hydraulic system as soon as the pressure in the hydraulic system has fallen below an adjustable value.

Other features which are considered as characteristic for the invention are set forth in the appended claims.

Although the invention is illustrated and described herein as embodied in a method and device for optimally stabilizing the windings of transformers and chokes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
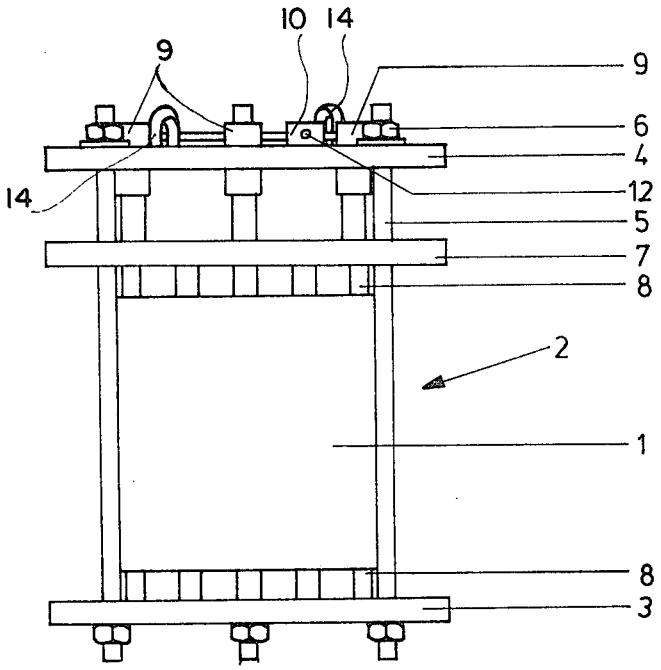
FIG. 1 is a diagrammatic side elevational view of a pressing fixture with a transformer winding inserted therein.

Referring now to the figures of the drawing and first, particularly to FIG. 1 thereof, there is seen a cylindrical transformer winding 1 which is wound in a conventional manner with paper-insulated wires; the individual turns being spaced from each other by pressboard strips.

The winding 1 is inserted into the pressing fixture 2. This pressing fixture includes a lower, fixed pressure plate 3 and an upper, fixed pressure plate 4 which are held together by means of bolts or press rods 5 and nuts 6. The pressing fixture 2 further contains a movable pressure plate 7. There are three hydraulic jacks or pressure cylinders 9 in the upper, fixed pressure plate 4. The jacks 9 are screwed into the fixed pressure plate 4 by means of threads. Pressure tubes 10 lead from the pressure cylinders 9 to a two-way distribution valve 11 (see FIG. 2). A non-illustrated pressure hose can be connected to the nipple 12 of the distribution valve 11. This hose establishes the connection to the hydraulic control system disposed outside the drying oven. On the upper surface of the upper pressure plate 4 are further disposed two eyes 14 for suspension.

Figure 2:
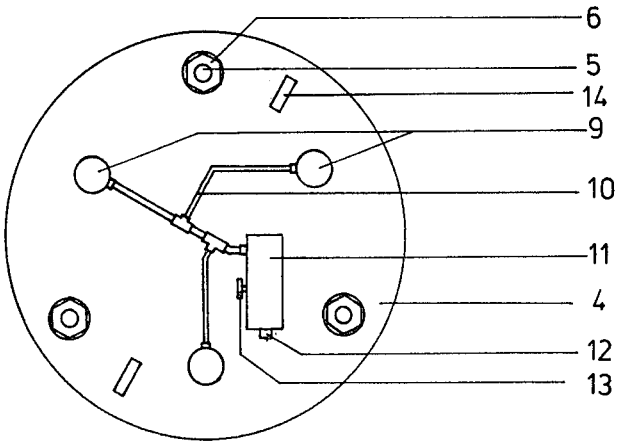
FIG. 2 is a top plan view of the pressing fixture of FIG. 1.

In FIG. 2 there are seen, on the upper surface or side of the upper fixed pressure plate 4, the three threaded bolts 5 with the nuts 6 screwed thereon. Also seen are the three hydraulic jacks 9 which are connected by means of pressure tubes 10 to the two-way distribution valve 11. Because of the layout of the piping shown, the same pressure is supplied to all of the hydraulic jacks 9. The second outlet 13 of the two-way distribution valve 11 is closed. If required, further hydraulic jacks can be connected to this outlet 13. These additional jacks can be fastened to the same pressing fixture or to a further pressing fixture contained in the drying oven. The number of jacks required for each pressing fixture substantially depends on the winding to be dried, the necessary pressure, the size of the jacks themselves and the pressure generated by the control system. Because of the high oven temperature, however, the number of hydraulic jacks should be kept as low as possible.

Figure 3:
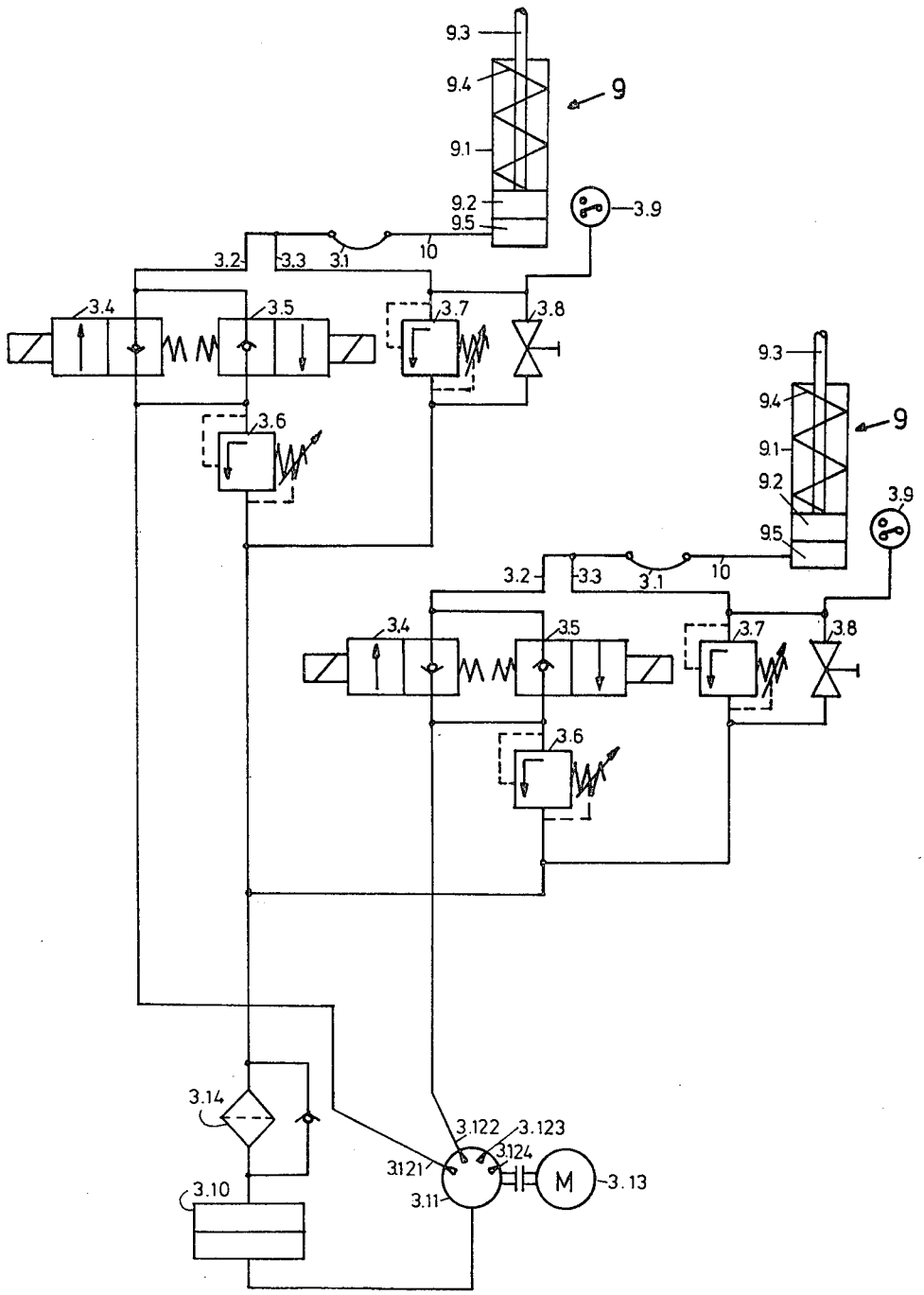
FIG. 3 is a hydraulic connection diagram of the control system for the pressing fixture.

In FIG. 3, two complete units for the hydraulic control system are seen. Shown are a pump 3.11 with four independent pressure connections 3.121, 3.122, 3.123 and 3.124, driven by the electric motor 3.13. The electric motor 3.13 may also include a timer for activating the control system at intervals in order to regulate the pressure in the hydraulic jacks 9. The timer may alternatively be located at a distance from the motor. The pump 3.11 draws pressure oil from an oil tank 3.10.

The pressurized oil flows through the line 3.121 to a first electrically-actuated shut-off valve 3.4. As soon as this valve is opened, the pressurized oil flows to the connecting line 10 disposed on the upper surface of the pressure tools. This pressure has been set at a pressure setting valve 3.6 through a line 3.2 and a pressure hose 3.1 which establishes the connection to the pressure tools in the non-illustrated drying oven. Pressurized oil also flows from the line 10 to the connected hydraulic jack 9. The jack 9 includes a cylinder 9.1, a piston 9.2, a piston rod 9.3, a spring 9.4 which returns the piston 9.2 to its base position, and an oil chamber 9.5. The hydraulic pressure prevailing in the oil chamber 9.5 is simultaneously fed through a further line 3.3, which in general serves as an oil return line, to a contact manometer 3.9 which has a minimum contact and a maximum contact. The maximum contact is set to a precalculated desired pressure. The minimum contact is set so that it does not respond when the system operates normally but acts reliably in the event of a defect. An adjustable overpressure valve 3.7 is further connected into the return line 3.3. A manual drain valve 3.8 is shunted across the return line 3.3. The valve 3.7 opens as soon as the maximum pressure in the line 3.3 is exceeded, which can happen, for instance, while the drying oven is being heated up, due to the large thermal expansion of the pressure oil resulting therefrom, if the winding does not shrink.

Parallel to the electrically actuated shut-off valve 3.4 is connected a further, likewise electrically actuated shut-off valve 3.5 which has, however, opposite oil flow direction. A pressure increase due to a rise in temperature can be brought down in a controlled manner with the valve 3.5. Between the two shut-off valves 3.4 and 3.5 and the oil tank 3.10, a pressure setting valve 3.6 is disposed. The valve 3.6 can conduct the pressurized oil from the pump 3.11 through the line 3.121 to the oil tank 3.10 by way of a filter 3.14. This is done if the valve 3.4 remains closed because, for instance, the minimum contact of the contact manometer 3.9 has responded due to a break, or if the set pressure in the hydraulic line has already been reached.

The control unit connected to the second line 3.122 which starts from the oil pressure pump 3.11, operates according to the same principle as the control unit just described. However, since the pressure line 3.122 is completely independent of the pressure line 3.121, a different desired pressure can be set in the second control unit. For this purpose, the overpressure valves 3.6 and 3.7 as well as the contacts of the contact manometer 3.9 are set to the different desired pressure valves.

There are claimed:

1. Method for optimally stabilizing the windings of transformers and chokes in a drying oven, which comprises pressing at least one winding in a drying oven at constant pressure during the entire drying process, and subjecting each winding to its required pressure if more than one winding is to be pressed simultaneously.

2. Method according to claim 1, which includes varying the pressure applied to each winding in proportion to the initial length of the winding.

3. Device for carrying out a method for optimally stabilizing the windings of transformers and chokes in a drying oven with a pressing fixture having two fixed pressure plates, rods connected between the fixed pressure plates, a movable pressure plate disposed between the fixed pressure plates, and means for exerting pressure on an end face of a winding disposed between one fixed pressure plate and the movable pressure plate, said pressure exerting means comprising a multiplicity of hydraulic jacks fixed in place during the stabilizing process, a first hydraulic line connecting said jacks to each other, and a second hydraulic line connecting said first hydraulic line to a hydraulic control system disposed outside the drying oven.

4. Device according to claim 3, wherein said hydraulic jacks are screwed into tapped holes formed in one pressure plate.

5. Device according to claim 3, including an at least two-way distribution valve disposed on an outer surface of one of the fixed pressure plates, said distribution valve being connected between said first and second hydraulic lines.

6. Device according to claim 3, wherein said hydraulic jacks are temperature resistant to at least 410 K.

7. Device according to claim 3, including a hydraulic pump connected to said second hydraulic line, and electrically actuatable valve means inserted in one of said hydraulic lines.

8. Device according to claim 3, including overpressure valve means inserted in one of said hydraulic lines.

9. Device according to claim 3, including a contact manometer inserted in one of said hydraulic lines, said manometer having settable desired pressure and overpressure contacts.

10. Device according to claim 3, including timing means connected to said control system for activating the control system at intervals and regulating the pressure in the hydraulic jacks.

11. Method for stabilizing the windings of transformers and chokes in a drying oven with a device including a pressing fixture having a movable and a fixed pressure plate and hydraulic jacks, and a hydraulic control system disposed outside the oven being connected to the jacks, which comprises inserting a winding which has been prepared for drying between the fixed and the movable pressure plate of the pressing fixture, exerting a desired pressure on the movable pressure plate with the hydraulic jacks, placing the pressing fixture in the drying oven, setting the desired pressure with the hydraulic control system disposed outside the oven and connected to the jacks, heating the drying oven, continuously regulating the pressure in the jacks to desired values during the drying process with the control system, and maintaining a constant pressure with the jacks after the drying process is completed and until the winding has cooled.

12. Method according to claim 11 which includes exerting pressure through a common hydraulic line connected to a plurality of jacks which act on a particular winding in a pressing fixture.

13. Method according to claim 11, which includes exerting pressure through a common hydraulic line connected to a plurality of jacks which act on a plurality of windings of the same type.

14. Method according to claim 12 or 13, which includes adjusting the pressure supplied to the jacks to desired values at fixed time intervals.

15. Method according to claim 12 or 13, which includes adjusting the pressure supplied to the jacks to desired values if the pressure deviates from the desired values by given amounts.

16. Method according to claim 14, which includes adjusting the pressure supplied to the jacks by activating a hydraulic pump and hydraulic valves connected to the common hydraulic line.

17. Method according to claim 15, which includes adjusting the pressure supplied to the jacks by activating a hydraulic pump and hydraulic valves connected to the common hydraulic line.

18. Method according to claim 11, which includes draining the hydraulic jacks after the stabilized winding has cooled.

19. Method according to claim 11, which includes diverting the supply of hydraulic pressure at least partly through another hydraulic line if a drop in pressure occurs due to a break in the hydraulic system.

* * * * *